US011602201B1

(12) United States Patent
Slabaugh et al.

(10) Patent No.: US 11,602,201 B1
(45) Date of Patent: Mar. 14, 2023

(54) HIGHLY ELASTIC COMPOSITES AND CONSTRUCTIONS FOR CONTINUOUS WATCH BAND DESIGN

(71) Applicant: Apple Inc., Cupertino, CA (US)

(72) Inventors: Scott W. Slabaugh, Gilroy, CA (US); Tatsuya Sano, San Jose, CA (US); Jen-Chun Hsu, Taipei (TW); Osamu Yabe, Mountain View, CA (US); Zaki Moustafa, Palo Alto, CA (US); Motohide Hatanaka, Menlo Park, CA (US); Hsiang Hung Chen, New Taipei (TW); Eiryo Shiraishi, Tokyo-to (JP)

(73) Assignee: APPLE INC., Cupertino, CA (US)

( * ) Notice: Subject to any disclaimer, the term of this patent is extended or adjusted under 35 U.S.C. 154(b) by 795 days.

(21) Appl. No.: 16/566,806

(22) Filed: Sep. 10, 2019

Related U.S. Application Data

(60) Provisional application No. 62/729,954, filed on Sep. 11, 2018.

(51) Int. Cl.
*A44C 5/00* (2006.01)
*G04B 37/14* (2006.01)

(52) U.S. Cl.
CPC ..... *A44C 5/0069* (2013.01); *G04B 37/1486* (2013.01)

(58) Field of Classification Search
CPC .... G04B 37/18; G04B 37/14; G04B 37/1486; G04B 37/16; G04B 37/1493; A44C 5/0069
See application file for complete search history.

(56) References Cited

U.S. PATENT DOCUMENTS

| | | | | | |
|---|---|---|---|---|---|
| 2,270,216 | A * | 1/1942 | Marwil | A44C 5/0069 | 224/175 |
| 2,338,332 | A * | 1/1944 | Jaten | A44C 5/0076 | 57/225 |
| 3,063,058 | A * | 11/1962 | Vollet | A44C 5/0069 | 224/175 |
| 5,038,718 | A * | 8/1991 | Pfleger | A01K 27/005 | 2/338 |
| 5,054,433 | A * | 10/1991 | Pfleger | A01K 27/005 | 2/338 |
| 10,455,906 | B1 | 10/2019 | Wu et al. | | |
| 2010/0300146 | A1 * | 12/2010 | Klecka | A44C 25/007 | 63/3 |
| 2019/0283309 | A1 * | 9/2019 | Kato | C08L 75/04 | |
| 2020/0121036 | A1 * | 4/2020 | Takasawa | G04B 37/14 | |

* cited by examiner

*Primary Examiner* — Jack W Lavinder
(74) *Attorney, Agent, or Firm* — BakerHostetler

(57) ABSTRACT

A band for securing an electronic device to a user may include a monolithic band body having proximal and distal ends for coupling to a body of the electronic device. The monolithic band body may include an elastic material that is elastically stretchable between (1) a fitted mode where the electronic device is secured to a limb of the user, and (2) a stretched mode for fitting over the limb of the user.

19 Claims, 6 Drawing Sheets

HIGHLY ELASTIC COMPOSITES AND CONSTRUCTIONS FOR CONTINUOUS WATCH BAND DESIGN

CROSS-REFERENCE TO RELATED APPLICATIONS

The present application claims the benefit of U.S. Provisional Patent Application Ser. No. 62/729,954, entitled "HIGHLY ELASTIC COMPOSITES AND CONSTRUCTIONS FOR CONTINUOUS WATCH BAND DESIGN," filed Sep. 11, 2018, which is hereby incorporated by reference in its entirety for all purposes.

TECHNICAL FIELD

The present description relates generally to securement of wearable devices, and, more particularly, to an elastic monolithic band for an electronic device, the band being capable of stretching sufficiently to fit over a user's body part, and contracting to securely fit on the user's body part.

BACKGROUND

Some electronic devices may be removably attached to a user. For example, electronic devices may be attached to a band which may be removably worn on a leg, a head, a chest or rib-cage, or any other specific part of the user's body depending on a function of the electronic device. In general, a wristwatch or fitness/health tracking device can be attached to a user's wrist by joining free ends of a band of the wristwatch or fitness/health tracking device together. In many cases, watch bands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Other bands may be elastic expansion-type bands that stretch to fit around a user's wrist, e.g., flexible bands including buckles, or metal bands including metal clasps. The degree of comfort and securement of the electronic device can depend on the function and arrangement of the watch band. However, conventional bands can have negative aspects and can undesirably fail prior to the failure of the wearable electronic device.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1A:
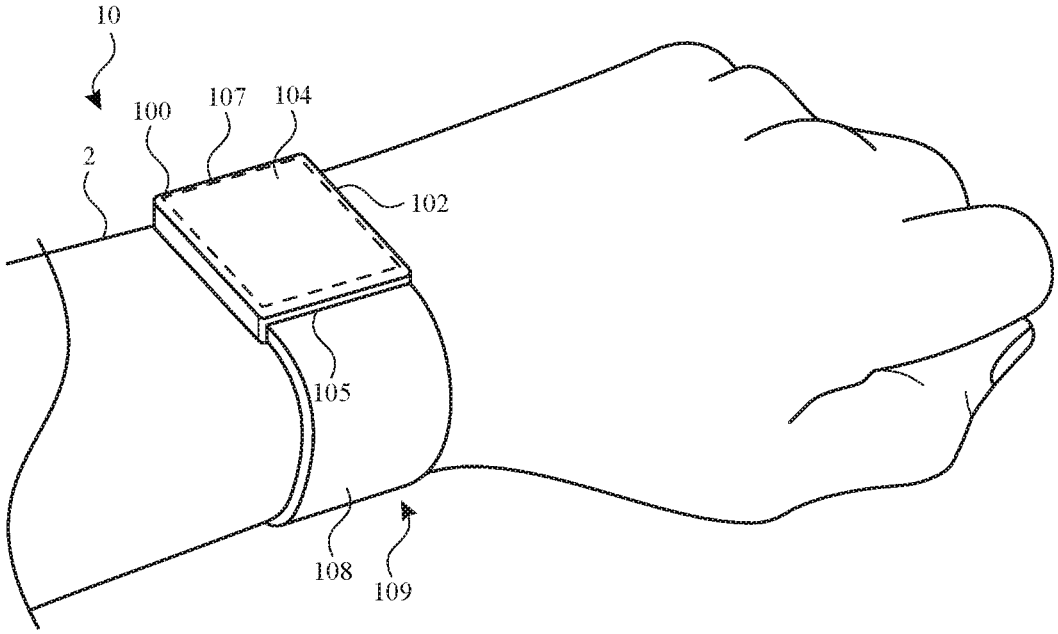
FIG. 1A shows a perspective view of a watch on a wrist of a user in a fitted state.

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

An electronic device, such as a wristwatch or fitness/health tracking device, can be attached to a user's wrist by a watch band. Conventional elastic bands can lose elastic properties over time and can become too big for a user's wrist. Other materials forming the flexible bands can tear or deteriorate over time due to forces applied at the hole of the flexible band by a tongue of a buckle. Metal bands including a metal clasp can include multiple components all coupled together, which can fail, become uncoupled, or otherwise malfunction over time. When a conventional wearable band fails and/or is incapable of securely attaching the electronic device to a user's wrist, the band needs to be replaced and/or the wearable electronic device can be susceptible to damage. Furthermore, when a conventional wearable band fails and/or is incapable of securely attaching the electronic device to a user's wrist.

Various embodiments of the present disclosure are directed to providing a monolithic or one-piece wearable band for electronic devices, which is configured to maintain a secure attachment to the wrist so that the electronic device does not shift excessively or slip off of the user. Securement of the electronic device against the user can also be important for the function of electronic magnets, such as biometric sensors. Additionally, it can be desirable to maximize the comfort of the user while wearing the electronic device. Often, a secure attachment can apply an undesirable amount of force on the wrist of the user. In many cases, conventional watch bands may catch, pinch, or pull a user's hair or skin during use if the band is overly tight. In other cases, watch bands may slide along a user's wrist, turn about a user's wrist, or may be otherwise uncomfortable or bothersome to a user if the band is overly loose. These problems can be exacerbated during periods of heightened physical activity, such as while running or playing sports.

Furthermore, adjusting the size or fit of conventional watch bands often requires multiple steps, specialized tools, and/or technical expertise. Sizing options available to a user may be insufficient to obtain a proper fit. The fit may be different and/or may be perceived to be different given certain environmental (e.g. temperature, humidity) or biological conditions (e.g., sweat, inflammation). As a result, users of conventional wristwatches and/or fitness/health tracking devices may select a tolerable (although not optimally comfortable) fit, reserving tight bands for fitness/health tracking devices and loose bands for conventional wristwatches. However, some wearable electronic devices may be multi-purpose devices, providing both fitness/health tracking and timekeeping functionality. Accordingly, the various embodiments of the present disclosure provide watch bands having a closed loop/monolithic/one-piece configuration which are capable of being elastically stretched to fit over a user's hand and contractible to comfortably and securely fit over the user's wrist to maintain contact with the fitness/health tracking sensors, without being overly tight.

Additionally, it may be desirable to provide a closed loop/monolithic/one-piece watch band formed of highly elastic materials and mechanical designs to enable a targeted extension force profile. For example, the closed loop/monolithic/one-piece watch band of the various embodiments described herein may be designed or otherwise configured to maintain a stress of the single-piece watch band body in the stretched mode substantially constant against a variation in strain of the closed loop/monolithic/one-piece watch body.

Embodiments of the present disclosure provide closed-loop watch bands formed of monolithic materials developed to meet a high extension to enable installation of the watch without detaching the band while contracting to a low constant force for long term wearing. For example, specific monolithic materials may be selected and a surface area of the monolithic materials may be modified such as by creating pores in the monolithic materials. This modification may thereby reduce the amount of force exerted by the watch band on the user's wrist as compared to conventional material, while still providing secure attachment to the user. Embodiments of the present disclosure provide ease of watch installation by a user as well as secure fitting to avoid looseness in fit of the watch under external forces.

According to some embodiments, a one-piece watch band may include multiple different materials combined together so as to provide the targeted extension force profile. For example, various materials having different properties may be combined or layered to produce a continuous closed loop body favoring high extension in some areas, and higher strength and stiffness in other areas. The aforementioned configuration advantageously allows for extension of the one-piece watch band during installation over the hand, while also allowing contraction of the one-piece watch band to the lower force for long-term secure and comfortable wearing on the user's wrist without being overly tight.

According to some embodiments, a one-piece watch band may include an internal mechanical structure, for example an auxetic structure or material configured to unfold and/or collapse at a designed force in order to maintain a substantially constant low force profile during extension of the one-piece watch band.

Various embodiments of the present disclosure are thus directed to providing teaching of a monolithic or one-piece watch band without a clasp or other separate length adjustment and/or securement mechanism whereby the band is formed of a material capable of being stretched and deformed to a strain of up to 75% to fit over a user's hand, and contractible back to a strain of between 1-5% for comfortable wearing, without plastically deforming.

These and other embodiments are discussed below with reference to FIGS. 1-9B. However, those skilled in the art will readily appreciate that the detailed description given herein with respect to these Figures is for explanatory purposes only and should not be construed as limiting.

Figure 1B:
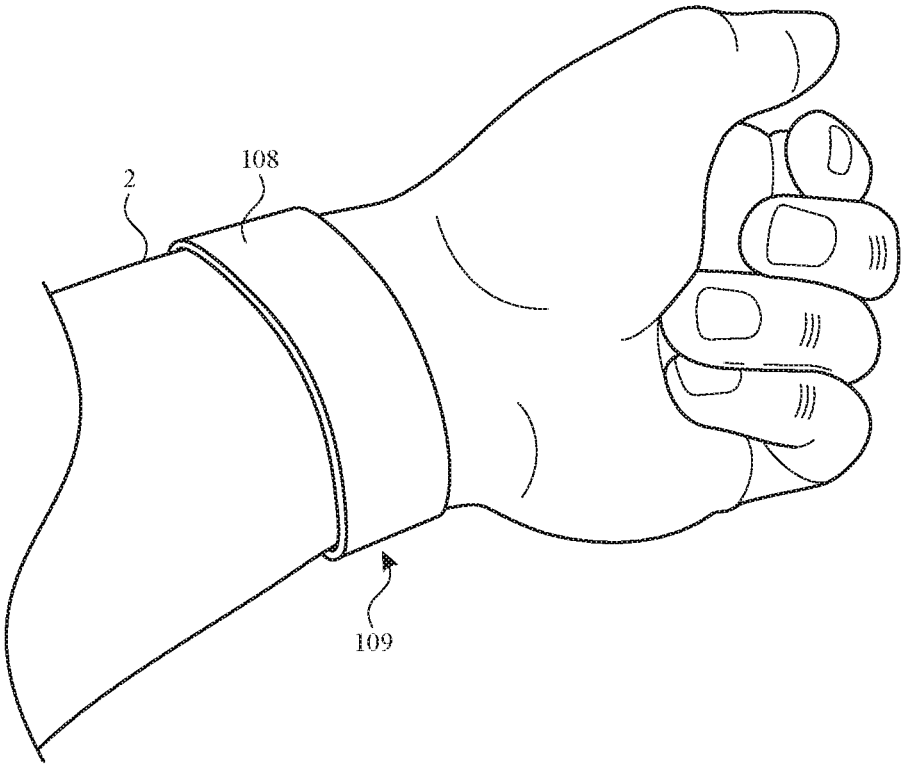
FIG. 1B shows another perspective view of the watch of FIG. 1 on the wrist of the user in the fitted state.
Figure 2:
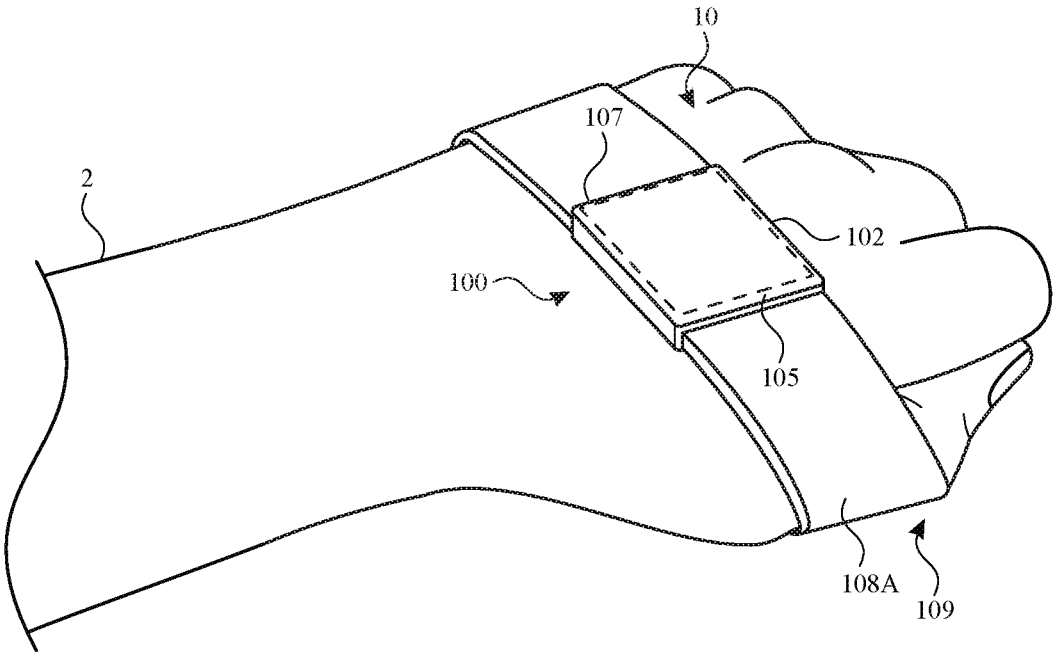
FIG. 2 shows a perspective view of the watch of FIG. 1 stretched over a hand of the user.

Referring to FIGS. 1A, 1B, and 2, an example of a wearable electronic device, such as a watch 10, is shown. While FIG. 1A illustrates the device as the watch 10, it will be recognized that features described herein with respect to the watch 10 can be applied to a variety of other devices, such as other wearable devices, other electronic devices, portable computing devices, fitness/health tracking devices, cell phones, smart phones, tablet computers, laptop computers, cameras, timekeeping devices, computerized glasses, and other wearable devices navigation devices, displays, sports devices, accessory devices, health-monitoring devices, medical devices, watch bands, bracelets, jewelry, and/or the like.

As shown in FIG. 1A, the watch 10 includes an electronic device 100 which may be worn on a body part, for example, a limb, a chest, a head, a rib cage, or any other appropriate body part of a user depending on function of the electronic device 100. For the purposes of the present description, the electronic device 100 will be depicted being worn on a wrist 2 of a user with a watch band 109. The electronic device 100 can be any portable device that can be attached to the aforementioned body parts of the user or to other devices, structures, or objects. The watch band 109 can be flexible and encircle at least a portion of the wrist 2 of a user. By securing the electronic device 100 to the person of the user, the watch band 109 provides security and convenience. In some embodiments, the electronic device 100 includes a display 104 and a housing 102. As shown in FIG. 1B, the watch band 109 extends to an opposite side of the wrist 2 from the electronic device 100. As depicted, the watch band 109 includes a monolithic closed-loop watch band body 108A having proximal and distal ends 105, 107 for coupling to the watch 10.

Figure 3:
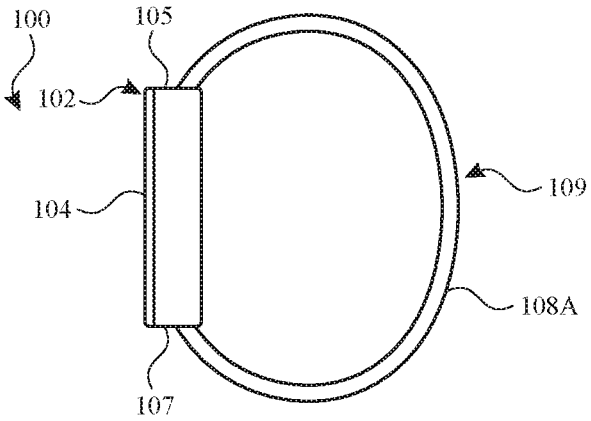
FIG. 3 shows a side view of a watch with a monolithic elastic watch band.
Figure 4:
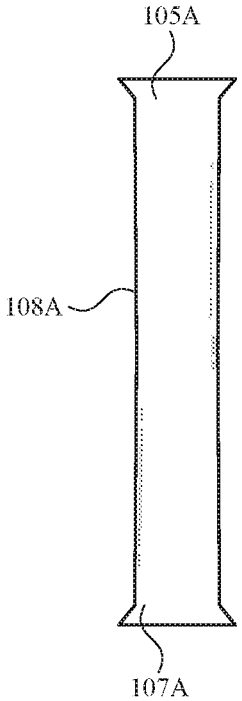
FIG. 4 shows a schematic view of the monolithic elastic watch band of FIG. 3.

Referring now to FIGS. 2, 3 and 4, with continued reference to FIGS. 1A and 1B, the monolithic watch band body 108A may be formed of an elastic material that is elastically stretchable between a fitted mode (illustrated in FIGS. 1A and 1B) and a stretched mode (illustrated in FIG. 2). As shall be discussed from here onwards, the fitted mode refers to a state in which the monolithic watch band body 108A is fitted and secured on the wrist of a user. For example, in the fitted mode, the watch band body 108A exerts a force on the user's wrists to counter a force exerted by the user's wrist to stretch the band 108A from its natural state (zero extension) to the fitted state to accommodate the user's wrist size. In the fitted mode, the watch is secured on the wrist of the user to prevent the watch from loosely shifting up and down, or loosely twisting or circling around the wrist 2 of the user. This may be an important aspect in order for any health sensors or any other types of sensors or electronics which rely on a certain degree of proximity to skin to be able to operate efficiently. Accordingly, when the watch band body 108A is secured to the wrist 2 of the user, direct contact of the watch 10 may be maintained with the wrist 2 of the user in a manner that prevents the watch 10 from loosely shifting up and down, or loosely twisting or circling around, the wrist 2 of the user. Furthermore, when the watch 10 is secured to the wrist of the user, the monolithic watch band body 108A may contact the wrist continuously along a majority of its length, and/or opposing portions of the monolithic watch band body 108A may simultaneously be in contact. Additionally, when the watch 10 is secured to the wrist 2 of the user the watch housing 102 and the portion of the wrist 2 opposite to the watch housing may maintain contact. Accordingly, as shall be described from here onwards, the stretched mode refers to a state in which the monolithic watch band body 108A is stretched to fit over the hand of the user to be placed on the wrist 2. For example, in the stretched mode, the watch band body 108A exerts a force to counter a force exerted by the user to stretch the watch band body 108A from its natural state (zero extension) to the stretched state to provide a necessary clearance for the watch band body 108A to pass over the user's hand. In accordance with some embodiments, as shall be illustrated and discussed in further detail with respect to FIGS. 5A and 5B, the structure of the monolithic watch band body 108A exhibits a relatively low and flat (constant) force profile when stretched between the fitted mode and the stretched mode. The aforementioned configuration is advantageous in that a force applied to get the watch band body 108 over the user's hand is minimized, and accordingly a minimized amount of force is required to be exerted by the watch band body 108A to contract the watch band body 108 to securely fit on the user's wrist 2 without being overly too tight. As defined herein, the term "contract" refers to a configuration where the monolithic or one-piece watch band body shrinks or reduces in length in response to a reduction of the force applied to stretch the monolithic or one-piece watch band body. For example, once the force applied to the monolithic or one-piece watch band body is reduced, the monolithic or one-piece watch band body may contract from the stretched mode (illustrated in FIG. 2) to the fitted mode (illustrated in FIGS. 1A and 1B) to comfortably and securely fit over the user's wrist 2 without being overly tight. Similarly, when the user takes off the watch 10, the monolithic or one-piece watch band body is stretched from the fitted mode to the stretched mode to fit over the user's hand, and then contracted from the stretched mode back to a non-deformed or un-stretched state (illustrated in FIG. 3).

Figure 5A:
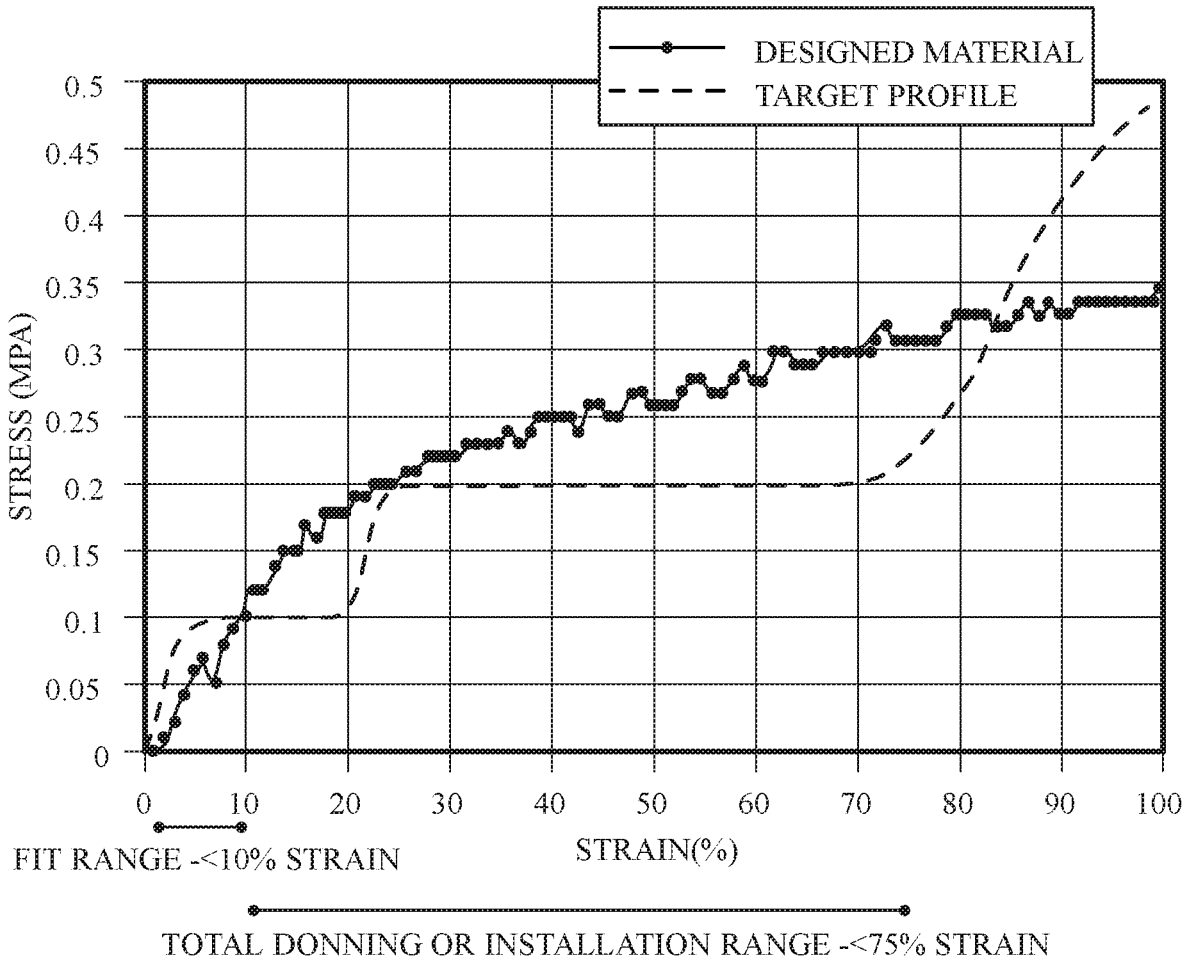
FIG. 5A shows a "stress-strain" curve of the monolithic elastic watchband of FIG. 4.
Figure 5B:
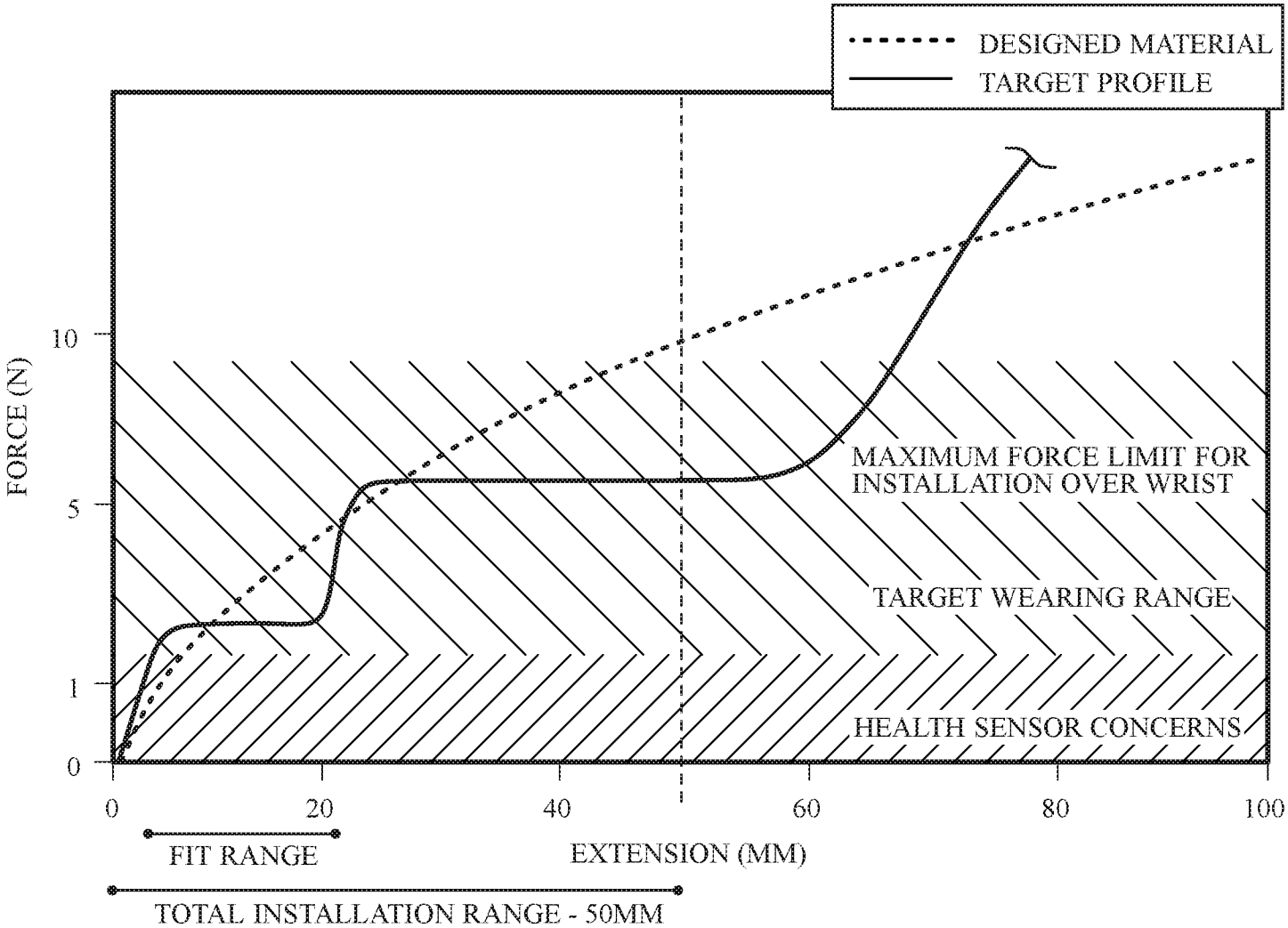
FIG. 5B shows a "force-displacement" curve of the monolithic elastic watch band of FIG. 4.

FIG. 5A shows a "stress-strain" curve of the monolithic elastic watchband of FIG. 4. FIG. 5B shows a "force-displacement" curve of the monolithic elastic watch band of FIG. 4. As defined herein, stress refers to an internal force exerted by an object in response to an external force exerted to deform the object, whereby the internal force acts to restore the object to its original non-deformed state. As further defined herein, strain refers to a percentage deformation of the monolithic elastic watchband from its initial non-deformed state. In general, a "stress-strain" curve of a conventional elastic material indicates that as increases, strain (deformation of the object resulting from the stress) increases relatively proportionately until a point of plastic deformation. However, in the case of certain materials, there exists a region (superelastic region) where the stress remains constant in spite of an increase in strain as shown by the solid flat line labelled "target profile." For the purposes of discussion of the various embodiments of the present disclosure, a state of the monolithic watch band body where the stress (force per unit area exerted by the monolithic band body 108A on the user) remains constant in spite of an increase in strain (for example as illustrated in FIG. 5A where the stress remains substantially constant (e.g., as depicted, within force per unit area of 0.1 MPa) in spite of a disproportionately higher increase in strain (e.g., as depicted, within deformation of 25-75% strain) shall be referred to as a constant or flat force profile. In practice, this constant force profile is experienced by the user when the amount of force the user needs to apply on the monolithic elastic watchband 108A remains substantially constant (only a slight variation, as shall be described with respect to specific examples below) while the amount of stretch or deformation of the monolithic elastic watchband is increased. Advantageously, and in contrast to conventional watch bands, the amount of force the user needs to apply to elastically stretch the monolithic band body 108A does not substantially increase within a certain range of increased elongation, as shall be described with respect to specific examples below). Consequently, the internal force that the monolithic band body 108A exerts on the user's hand and wrist to restore the object to its original non-deformed state is reduced as compared with conventional watch bands. The aforementioned configuration thus allows the monolithic band body 108A to contract to a strain level where a physically "comfortable," (i.e., not overly tight and constricting) and "secure" force is exerted on the user's wrist in the fitted mode.

As illustrated by the line labeled "designed material," the various embodiments of monolithic materials, and one-piece composites and structures as shall be described in further detail below with regards to FIGS. 6-9B provide monolithic and one-piece bands capable of closely mimicking the flat force profile exhibited in a superelastic region. Various embodiments of the present disclosure are directed to providing a monolithic or one-piece watch band capable of maintaining a low and substantially constant force profile for a desired range or percentage of deformation or strain that the monolithic or one-piece watch band is subject to across a range of user wrist sizes.

As depicted in FIG. 5A, the stress associated with the various embodiments of materials, composites and structures described herein remains substantially constant or flat as the monolithic elastic watchband is stretched between the fitted mode (illustrated in FIGS. 1A and 1B) and the stretched mode (illustrated in FIG. 2). For example, in some embodiments, the monolithic elastic watchband (designed material) may exhibit a constant force profile (illustrated and discussed with respect to FIGS. 5A and 5B) when stretched between (1) the fitted mode at a force ranging from about 0.1 N to about 7.5 N, and (2) the stretched mode at a force of less than 13 N such that a deformation of the monolithic watch band body in the fitted state is maintained between about 1% to about 5% strain, and a deformation of the monolithic watch band body in the stretched mode ranges from about 25% to about 75% strain. More specifically, as illustrated in FIGS. 5A and 5B, the monolithic elastic watch band body 108A (designed material) may exhibit a substantially constant force profile when stretched between (1) the fitted mode at a force ranging from about 0.25 N to about 2.5 N, and (2) the stretched mode at a force ranging from about 5 N to about 13 N such that a deformation of the monolithic watch band body in the fitted mode is maintained between about 0.25% to about 2.5% strain, and a deformation of the monolithic watch band body in the stretched mode ranges from about 25% to about 75% strain. The aforementioned configuration is advantageous in that the monolithic watch band without a clasp or other separate length adjustment and/or securement mechanism is formed of a material capable of being stretched to a deformation of up to 75% strain to fit over a user's hand, and contractible back to a deformation of between 1-5% strain for comfortable wearing, without plastically deforming. In some embodiments, the monolithic watch band may be formed of an elastic material configured to stretch up to 600% in length without plastically deforming.

In accordance with some embodiments, the elastic material of the monolithic watch band body 108A may be a material selected from the group consisting of at least one of elastomers, silicones, fluorosilicones, urethanes, synthetic thermosets, and any combination thereof. However, the various embodiments of the present disclosure are not limited to the aforementioned materials, but may apply to any material capable of achieving the desired extension force profile. In some embodiments, the elastic material of the monolithic watch band body 108A may have a hardness of at least 14A shore, for example the hardness may range from about 14A shore to about 20A shore to maintain the desired force profile. In other embodiments, however, the elastic material of the monolithic watch band body 108A may have a hardness of greater than 20A shore to maintain the desired force profile. In some embodiments, the elastic material of the monolithic watch band body 108A may have a Young's Modulus ranging from about 0.1 Megapascals to about 2.0 Megapascals, and in some specific embodiments, ranging from about 0.1 Megapascals to about 1.0 Megapascals to maintain the desired force profile.

Figure 6A:
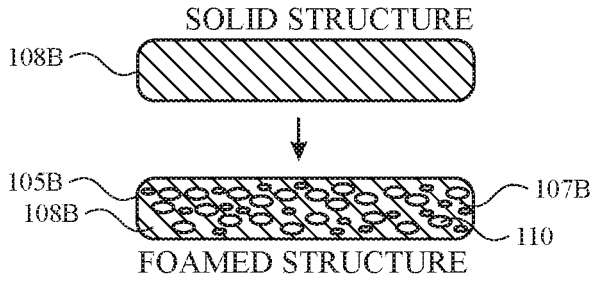
FIG. 6A shows a top view.
Figure 6B:
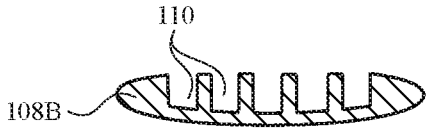
FIG. 6B shows a cross-sectional view.
Figure 6C:
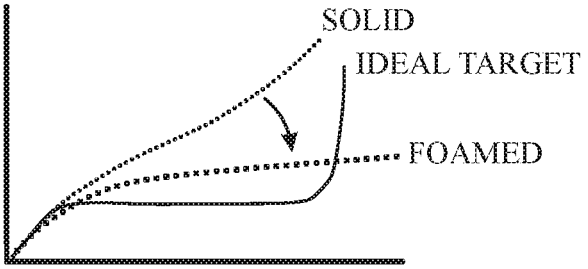
FIG. 6C shows a "stress-strain" curve of a porous monolithic watch band.

FIG. 6A shows a top view, FIG. 6B shows a cross-sectional view, and FIG. 6C shows a "stress-strain" curve of a porous monolithic watch band 108B. In accordance with some embodiments, as depicted in FIGS. 6A and 6B, a structure of the monolithic watch band body 108A (illustrated in FIG. 4) may be modified as illustrated by the porous monolithic watch band 108B to include multiple pores 110 to create a foam-like structure. The aforementioned configuration is advantageous in that a continuous force profile of the porous monolithic (foamed) watch band 108B (as illustrated in FIG. 6C) is lower than that of the solid monolithic watch band body 108A. This is due to the fact that the porous monolithic watch band 108B is of a foam-like structure and thus has a decreased cross-section as compared with the monolithic watch band 108A (assuming a same size watch band). Since the relationship of stress is defined as force per unit area, a decrease in the area would cause a corresponding decrease in the force exerted by the porous monolithic watch band 108B for a specific stress level, as illustrated in FIG. 6C. As such, the various embodiments of the present disclosure may utilize a monolithic material having a slightly higher rigidity, for example, an elastomer, and still be able to achieve the desired extension force profile.

Figure 7A:
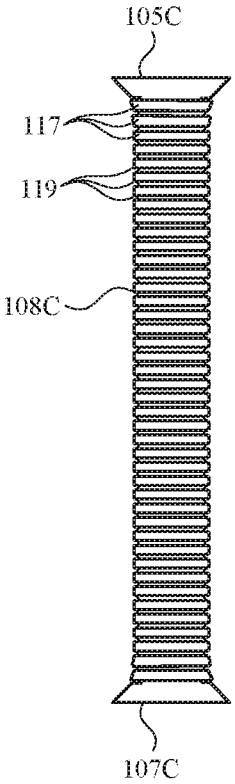
FIGS. 7A and 7B show schematic views of one-piece composite material elastic watch bands.
Figure 7B:
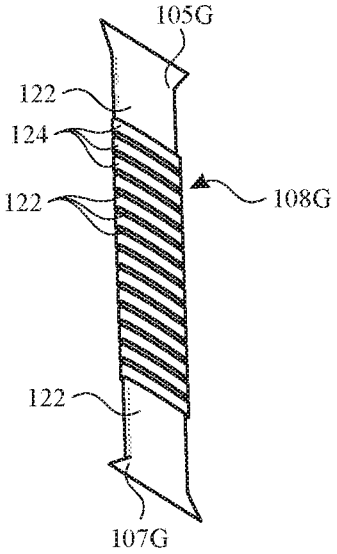

FIGS. 7A and 7B show schematic views of one-piece composite material elastic watch bands. FIG. 7A, depicts a one-piece composite material elastic watch band 108C formed of an elastic corded material. Similar to the monolithic watch band body 108A, the composite material elastic watch band 108C includes a proximal end 105C and a distal end 107C for coupling to the watch housing 102 (illustrated in FIG. 3). In the embodiments illustrated in FIG. 7A, the one-piece composite material elastic watch band 108C may include several links 117 made of a first material coupled to each with a second material 119 interposed between the links 117. The first material may be a slightly stiffer material than the second material, and the second material 119 (forming the elastic cording) may be more elastic than the first material. As defined herein the elastic corded material may refer to a material having an elastic material 119 interposed between and joining adjacent links 117 of the material. Advantageously, the aforementioned configuration allows for a lower force to be used for stretching and placing the composite material elastic watch band 108C over the user's hand.

FIG. 7B, depicts a one-piece composite material elastic watch band 108G. Similar to the monolithic watch band body 108A, the composite material elastic watch band 108G includes a proximal end 105G and a distal end 107G for coupling to the watch housing 102 (illustrated in FIG. 3). In the embodiments illustrated in FIG. 7B, the one-piece composite material elastic watch band 108C may include several alternating strips of material 122 and 124. The first strip of material 122 may be made of a material different than the material of the second strip 124. Similar to the embodiments of FIG. 7A, the first material 122 may be a stiffer, more rigid, or more elastic material than the second material 124 in order to allow for a lower force to be used for stretching and placing the composite material elastic watch band 108G over the user's hand.

As previously described, a lower force exerted by the user would accordingly correspond to a lower force exerted back on the user by the band in an effort to revert back to the band's non-deformed state. Advantageously, the aforementioned configuration, similar to that of the monolithic watch band body 108A and the porous foam-like monolithic watch band 108B discussed above, allows for the composite material elastic watch bands 108C and 108G to exert a force that is sufficient to secure the band on the user's wrist when in the contracted, fitted mode, without being overly too tight. As such, the composite material elastic watch bands 108C, 108G may stretch more at the locations of the less stiffer and less rigid of the materials 122 and 124, and advantageously provider a lower constant force profile than that achievable using just the stiffer or more rigid one of the materials 122, 124. Accordingly, the amount of force necessary to slide the one-piece composite material elastic watch band 108C, 108G over the user's hand, and to contract the watch band 108C, 108G back to the fitted mode may be reduced.

Figure 8A:
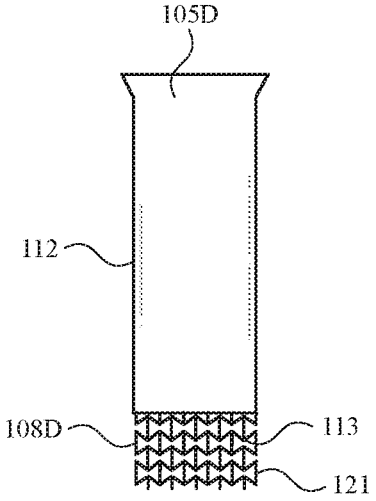
FIGS. 8A and 8B show schematic views of a one-piece support structure for coupling to a watch housing.
Figure 8B:
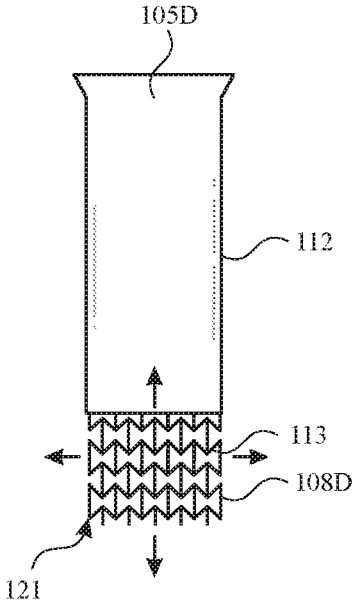

FIGS. 8A and 8B show schematic views of a one-piece support structure 108D having a proximal end 105D and a distal end (not shown) for coupling to the watch housing 102 (illustrated in FIG. 3). As depicted, the one-piece support structure 108D incorporates a mechanical collapsing design in order to advantageously produce a low constant force profile. For example, in some embodiments, the one-piece support structure 108D may be an auxetic material that is elastically stretchable between the fitted mode (e.g., as illustrated in FIG. 8A) and the stretched mode (as illustrated in FIG. 8B). The auxetic materials advantageously exhibit unique form-fitting deformation characteristics which are advantageous in providing the desired extension force profile. For example, the auxetic structure or material may have a hinged structure (as illustrated by hinges 113) and be configured to unfold and/or collapse at the hinges to maintain a substantially constant low force profile when stretched.

As defined herein hinges 113 of the auxetic material refer to joints that attach the cells 121 together while allowing for limited movement between the cells 121. In particular, when the one-piece support structure 108D is stretched, the hinge-like features collapse as indicated by the arrows in FIG. 8B to keep the strain low during extension or stretching of the one-piece watch band. The layout of the auxetic structure or material is such that a tensile deformation generates a bidirectional expansion, as shown in FIGS. 8A and 8B. Being subjected, for example to the tensile force, the hinges 113 in the corners rotate, forcing the structure to unfold and/or collapse on itself. In accordance with some embodiments, the auxetic structure can be obtained in numerous geometries, including rectangles, squares, triangles, and any other shape exhibiting similar characteristics. Due the aforementioned geometry, when the when the auxetic one-piece support structure 108D is subjected to a tensile compressive force (not illustrated), or a tensile force as illustrated, each one of the individual cells suffers a torsion effect. In this way, the hinges in the corners rotate, thereby causing the cells to twist and untwist, generating a contraction or expansion behavior in the auxetic one-piece support structure 108D.

In accordance with some embodiments, a layer of skin 112 may be coated or otherwise formed overlaying the one-piece support structure 108D. The skin 112 may be a thin coating material or jacket formed so as to prevent interference or inhibiting of the auxetic properties of the one-piece support structure 108D. The skin 112 may be formed having a proximal end and a distal end corresponding to the proximal and distal ends of the one-piece support structure for coupling to the watch housing.

Figure 9A:
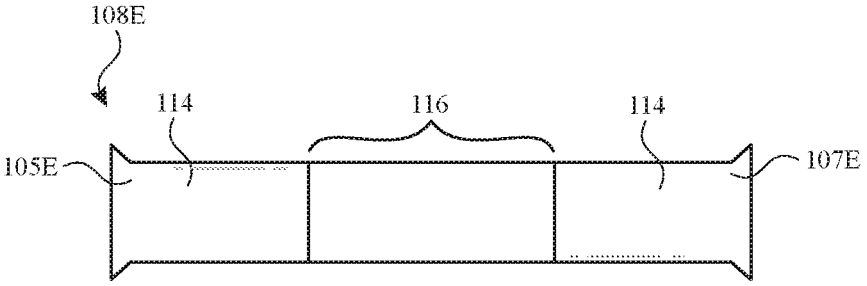
FIGS. 9A and 9B show schematic views of one-piece composite material elastic watch bands.
Figure 9B:
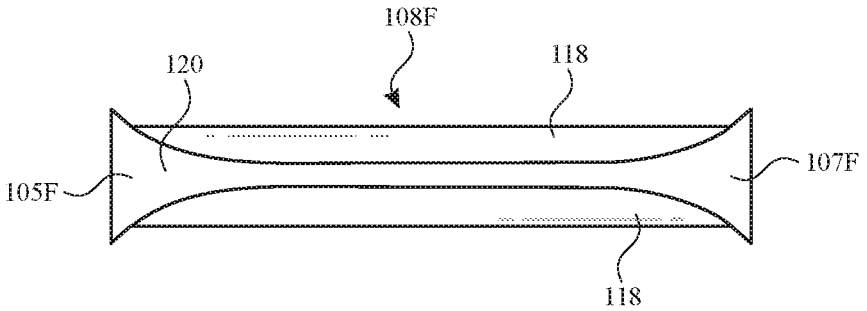

FIGS. 9A and 9B show schematic views of one-piece composite material elastic watch bands. FIG. 9A illustrates a one-piece composite material elastic watch band 108E. Similar to the monolithic watch band body 108A, the composite material elastic watch band 108E includes a proximal end 105E and a distal end 107E for coupling to the watch housing 102 (illustrated in FIG. 3). In the embodiments illustrated in FIG. 9A, the composite material elastic watch band 108E may be formed of multiple materials 114 and 116. The materials 114 and 116 may be arranged so as to have different strengths and/or elasticities. In this way, the composite material elastic watch band 108E may be configured to stretch more in locations of the material 114 or 116 having the higher elasticity. Similarly, FIG. 9B illustrates a one-piece composite material elastic watch band 108F. Similar to the monolithic watch band body 108A, the composite material elastic watch band 108F includes a proximal end 105F and a distal end 107F for coupling to the watch housing 102 (illustrated in FIG. 3). In the embodiments illustrated in FIG. 9B, the composite material elastic watch band 108F may be formed of multiple materials 118 and 120. The materials 118 and 120 may be arranged so as to have different geometries and/or strengths and/or elasticities. In this way, the composite material elastic watch band 108F may be configured to stretch according to the desired force profile. For example, the composite material elastic watch band 108F may be formed with material 120 having a higher strength than that of material 118, or vice-versa to achieve a desired force profile, and to prevent necking of the material. The aforementioned configurations are advantageous in that by varying the geometries of portions of the materials forming the cone-piece composite watch bands, the tensile and shear strengths, the rigidities of the materials, as well as other properties of the materials of various materials in a composite material elastic watch bands, how the material elastic watch band deforms over time may be controlled.

In accordance with some embodiments, the elastic material of the one-piece watch bands 108C-108F may be a material selected from the group consisting of at least one of elastomers, silicones, fluorosilicones, urethanes, synthetic thermosets, and any combination thereof. However, the various embodiments of the present disclosure are not limited to the aforementioned materials, but may apply to any material capable of achieving the desired extension force profile. In some embodiments, the elastic material of the monolithic watch band body 108A may have a hardness of at least 14A shore, for example the hardness may range from about 14A shore to about 20A shore to maintain the desired force profile. In other embodiments, however, the elastic material of the monolithic watch band body 108A may have a hardness of greater than 20A shore to maintain the desired force profile. In some embodiments, the elastic material of the monolithic watch band body 108A may have a Young's Modulus ranging from about 0.1 Megapascals to about 2.0 Megapascals, and in some specific embodiments, ranging from about 0.1 Megapascals to about 1.0 Megapascals to maintain the desired force profile.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the terms include have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and magnets are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A band for securing an electronic device to a user, the band comprising:

a monolithic band body having proximal and distal ends for coupling to a body of the electronic device, wherein the monolithic band body comprises an elastic material that is elastically stretchable between (1) a fitted mode where the electronic device is secured to a limb of the user, and (2) a stretched mode for fitting over the limb of the user, wherein the elastic material exhibits a substantially constant force profile when stretched between (1) the stretched mode at a first force and (2) the fitted mode at a second force, to maintain a stress of the monolithic band body in the fitted mode substantially constant against a variation in strain of the monolithic band body.

2. The band of claim 1, wherein the elastic material of the monolithic band body is elastically stretchable from a level of 1% strain in the fitted mode up to a level of 75% strain in the stretched mode without plastically deforming.

3. The band of claim 1, wherein the elastic material exhibits the substantially constant force profile when stretched between (1) the fitted mode at about 0.1 N to about 7.5 N and (2) the stretched mode at less than 13 N, to maintain the stress of the monolithic band body in the fitted mode substantially constant against the variation in strain of the monolithic band body.

4. The band of claim 1, wherein the elastic material comprises a material selected from the group consisting of at least one of elastomers, silicones, fluorosilicones, urethanes, synthetic thermosets, and any combination thereof.

5. The band of claim 1, wherein the monolithic band body comprises a porous monolithic material.

6. A band for securing an electronic device to a user, the band comprising:

a monolithic band body having proximal and distal ends for coupling to a body of the electronic device, wherein the monolithic band body comprises an elastic material that is elastically stretchable between (1) a fitted mode where the electronic device is secured to a limb of the user, and (2) a stretched mode for fitting over the limb of the user, wherein the elastic material has a Young's Modulus ranging from about 0.1 Megapascals to about 2.0 Megapascals.

7. The band of claim 1, wherein the elastic material is configured to stretch up to 600% in length without plastically deforming.

8. The band of claim 1, wherein a deformation of the monolithic band body in the stretched mode is maintained between about 25% to about 75% strain, and a deformation of the monolithic band body in the fitted mode ranges from about 1% to about 5% strain.

9. A watch band for securing a watch to a wrist of a user, the watch band comprising:

a one-piece structure having a proximal end to attach to a first side of a housing of the watch, and distal end configured to attach to a second side of the watch housing, wherein:

the one-piece structure comprises an elastic material;

the elastic material exhibits a substantially constant force profile when stretched between (1) a fitted mode where the watch is secured to the wrist of the user, and (2) a stretched mode for fitting over a hand of the user; and in the fitted mode, the one-piece structure is configured to exert a force to secure the watch on the wrist.

10. The watch band of claim 9, wherein the elastic material exhibits the substantially constant force profile when stretched between (1) the fitted mode at about 0.1 N to about 7.5 N and (2) the stretched mode.

11. The watch band of claim 9, wherein the one-piece structure comprises an auxetic material.

12. The watch band of claim 11, wherein the auxetic material has a hinged structure configured to collapse in the stretched mode to maintain a substantially constant force profile during stretching of the one-piece structure.

13. The watch band of claim 11, further comprising a skin overlaying the one-piece structure, the skin having a proximal end and a distal end corresponding to the proximal and distal ends of the one-piece structure for coupling to the first and second sides of the watch housing.

14. The watch band of claim 9, wherein the one-piece structure comprises a composite material including multiple materials.

15. The watch band of claim 14, wherein portions of the multiple materials form different geometric shapes.

16. The watch band of claim 14, wherein the multiple materials differ in at least one of tensile strength, shear strength, and rigidity.

17. The watch band of claim 9, wherein the one-piece structure comprises an elastic corded material.

18. The watch band of claim 9, wherein the elastic material comprises an elastic material having a Young's Modulus ranging from about 0.1 Megapascals to about 2.0 Megapascals.

19. The watch band of claim 9, wherein the elastic material is configured to stretch up to 600% in length without plastically deforming.

* * * * *